US006913221B2

(12) United States Patent
Moon et al.

(10) Patent No.: US 6,913,221 B2
(45) Date of Patent: Jul. 5, 2005

(54) POWERED HOSE REEL SAFETY ENCLOSURE

(75) Inventors: Brian Moon, Dekalb, IL (US); Lyle Rosine, Batavia, IL (US); Torrence Anderson, Overland Park, KS (US)

(73) Assignee: Suncast Corporation, Batavia, IL (US)

( * ) Notice: Subject to any disclaimer, the term of this patent is extended or adjusted under 35 U.S.C. 154(b) by 49 days.

(21) Appl. No.: 10/649,015

(22) Filed: Aug. 25, 2003

(65) Prior Publication Data

US 2004/0046078 A1 Mar. 11, 2004

Related U.S. Application Data

(63) Continuation-in-part of application No. 10/346,908, filed on Jan. 17, 2003, and a continuation-in-part of application No. 29/154,133, filed on Jan. 18, 2002, now abandoned.

(51) Int. Cl.[7] ..... B65H 75/30; B65H 75/40

(52) U.S. Cl. ..... 242/390.8; 137/355.2

(58) Field of Search ..... 242/390.8, 390.9, 242/390, 390.1, 390.2, 390.3, 390.5, 390.6; 137/355.16, 355.17, 355.19, 355.2, 355.21, 355.22, 355.26, 355.27; 191/12.2 A

(56) References Cited

U.S. PATENT DOCUMENTS

| | | | | |
|---|---|---|---|---|
| 2,606,067 | A | 8/1952 | Roark | |
| 4,012,002 | A | 3/1977 | McDonald et al. | |
| 4,513,772 | A | 4/1985 | Fisher | |
| 4,832,074 | A | 5/1989 | Li | |
| 5,495,995 | A | 3/1996 | Dominique et al. | |
| 5,587,569 | A | 12/1996 | Mohtasham | |
| 5,897,430 | A | 4/1999 | Haller | |
| 6,050,290 | A | 4/2000 | Yacobi et al. | |
| D432,002 | S | 10/2000 | Anderson et al. | |
| 6,149,096 | A | 11/2000 | Hartley | |
| 6,338,360 | B2 | 1/2002 | Spear et al. | |
| 6,742,740 | B2 * | 6/2004 | Tisbo et al. | 137/355.26 |
| 2003/0098067 | A1 * | 5/2003 | Peterson | 137/355.2 |

* cited by examiner

*Primary Examiner*—John M. Jillions
(74) *Attorney, Agent, or Firm*—McHale & Slavin, P.A.

(57) ABSTRACT

A safety enclosure for a powered reel apparatus for use with an associated elongated flexible member. The reel is carried by and enclosed within the enclosure and is rotatable by a electric motor. The enclosure has left and right wall panels, front and rear wall panels extending between the left and right wall panels, and a cover. When one of the panels is in an open position, the motor is operationally locked out, and when one of the panels is rotated into a closed position, the motor is operable.

24 Claims, 7 Drawing Sheets

POWERED HOSE REEL SAFETY ENCLOSURE

CROSS REFERENCE TO RELATED APPLICATIONS

This application is a continuation-in-part of applicant's U.S. application Ser. No. 29/154,133 filed Jan. 18, 2002 now abandoned, the contents of which are hereby incorporated by reference. This application is also a continuation in part of applicant's co-pending U.S. application Ser. No. 10/346,908 filed Jan. 17, 2003, the contents of which are hereby incorporated by reference.

FIELD OF THE INVENTION

This invention is directed to a safety enclosure for powered hose rewinding apparatus. More specifically, the present invention relates to a protective safety enclosure for electrically powered, motor driven hose reels.

BACKGROUND OF THE INVENTION

Elongated flexible members such as hoses or electrical cords are a necessity for homeowners and industry alike. Typically, these elongated flexible members are found either wound and left on the ground near a fluid or electrical supply, or wound on one of many known reel-type storage devices.

The prior art has proposed a number of different structures for rewinding and storing a flexible elongate member when it is not in use. These devices generally include stationary reel hangers that can be mounted to a surface of a building or vehicle, as well as portable reel carts that permit ready transport of the flexible elongate member from one location to another.

For example, a typical surface mounted device or stationary reel hanger includes a rotatable fitting that is mounted to the building surface to which a manually rotated reel is mounted. To retrieve the flexible elongate member utilizing one of the stationary reel hangers requires manually winding the flexible elongate member around the structure or simply bundling the flexible elongate member into loose coils and hanging the bundle over the structure. Unfortunately, when hose is pulled out from such manually wound devices, it often becomes snarled or tangled and requires appreciable time and effort to correct the situation.

Portable flexible elongate member reel carts permit ready transport of the flexible elongate member from one location to another. Portable flexible elongate member reel carts typically include an open, manually rotatable reel or spool positioned between a pair of side frames with wheels. The flexible elongate member is manually wound upon the reel for storage and pulled or dispensed from the reel for use.

Although such carts have become wide-spread in use because of their portable storage capabilities, they do have drawbacks. First, these devices require manual winding of the hose. Rewinding a long flexible elongate member requires a considerable effort. Due to the low positional location of the winding mechanism on these devices, many users may be physically unable to complete the rewinding. Additionally, a flexible elongate member stored on such a reel is exposed to the elements. Often flexible elongate members are made of rubber or like materials that can become stiff or brittle and can break when subjected to ultra-violet radiation or low temperature extremes, particularly with advanced age.

In an effort to solve some of these problems, a number of flexible elongate member retrieval devices have been developed which automatically retrieve and rewind flexible elongate members on a reel in such a manner so as to avoid tangling the next time the flexible elongate member is deployed or paid out. Such devices generally include a powered reel to retrieve the flexible elongate member and a level wind mechanism for guiding the flexible elongate member onto the reel. The reel is generally driven by the combination of an electric motor and a speed reducer such as a gearbox or a chain and sprocket assembly. Power for the electric motor is generally provided by either household current or a battery. A simple electrical switch is activated to allow current to flow from the power supply to the electrical motor to rotate the powered reel. The level wind mechanism is typically also driven, via a drive train, by the same electric motor and includes a traversing screw, a guide rod, and a follower.

Unfortunately, many of these motorized devices lack a suitably safe enclosure to protect the operator and/or small children from being accidentally caught in the device or its drive train. The motors and drive train mechanisms utilized on these devices often have numerous pinch points and are capable of causing serious injury to an operator that inadvertently gets tangled in the device. In addition, the electric motors utilized in most of the prior art devices have voltage requirements that may cause an electrical shock in the absence of adequate guarding.

Moreover, none of the motorized hose reels known, are equipped with safety interlocks to prevent the electric motor from being engaged if an enclosure cover is opened. To compound the problem, many of these devices do not provide any means to immediately stop the retrieval of the flexible elongate member in the event of an emergency, requiring the entire flexible elongate member to be retracted before the device can be stopped. Retracting the entire flexible elongate member may take several seconds and exacerbates emergency situations such as when a person or pet has been caught in the device or the flexible elongate member as it is retracted.

Even further, none of the devices known provide a disengaging level-wind mechanism. The level-winds of the prior art are capable of causing severe damage to an operator, child or pet that may accidentally obstruct the path of the level-wind mechanisms as they traverse back and forth across the reel.

Accordingly, there exists a need for a motorized reel storage enclosure that permits safe motorized take-up of a flexible elongate member. The enclosure should cause the device to stop immediately when the enclosure is opened or tipped over. In addition, the level-wind utilized in the enclosure should disengage in the event that its path becomes blocked. Moreover, the enclosure should provide a means for an operator to quickly stop the retrieval of the flexible elongate member in an emergency situation. Such an enclosure should be capable of safely retracting and "hiding-away" the flexible elongate member stored therein when not in use, and provide a protective, outward aesthetically pleasing appearance.

DESCRIPTION OF THE PRIOR ART

A number of motorized reel assemblies utilizing electric motors to drive a reel for retracting an elongate member such as a cord or hose have been disclosed. Examples are disclosed as follows:

U.S. Pat. No. 4,832,074 discloses an automatic hose rewinding device having an alternating current (AC) motor driven reel. The desired amount of hose is pulled out of the enclosure manually for use. After use, the operator pushes a button and the hose is completely retracted until a device on the end of the hose strikes a bar to disengage the AC motor. The construction of the device requires the entire amount of hose pulled from the device to be retracted and does not teach or disclose any means of stopping the retraction in the event of an emergency. Additionally, the patent does not teach or disclose any type of interlock device that would prevent operation of the motor in the event that a cover is opened.

U.S. Pat. No. 4,513,772 discloses an automatic hose winding apparatus having an intermeshing, non-slipping clutch. The desired amount of hose is pulled out of the device manually for use. For retraction, the operator must manually lock the intermeshing clutch mechanism in place. When the hose is completely retracted, a device on the end of the hose strikes a lever to disengage the intermeshing clutch. The patent does not teach or suggest any type of a protective enclosure or a level-wind.

U.S. Pat. No. 5,495,995 discloses a motor driven hose reel assembly. The device interconnects two sensors and a motor to monitor the quantity of hose manually pulled from the reel. By pulling on the hose manually, the hose is rewound in an amount less than that necessary to completely rewind the hose. Because the device is operated in a retraction direction when the hose is pulled, the design requires the operator to overcome the pulling force of the device to extend hose from the machine. The patent does not teach or suggest any type of a protective enclosure over the reel portion of the device. In addition, the patent does not teach or suggest any interlocks or disconnects which would allow the device rewind cycle to be interrupted in an emergency situation.

U.S. Pat. No. 4,012,002 discloses a coupling mechanism for use in conjunction with a hose reel to automatically and selectively engage or disengage a reel and motorized drive train. The coupling utilizes a sliding spring pin on the reel which is designed to automatically engage one of a series of cooperating stop lugs on the drive train to transmit the driving power of the motor to the rotatable reel. The spring pin can be manually locked in a disengaged position to allow the hose reel to freewheel. When the spring pin is engaged the device operates in direct drive from the motor. The device utilizes chains and sprockets within the drive train for which there is not any teaching or suggestion of any type of a protective enclosure or a level-wind.

U.S. Pat. No. 6,149,096 discloses a retractable reel device especially useful for electrical cables. The device is specifically designed to allow an operator to pull out a desired amount of cable. Once the cable is paid out, the device maintains a predetermined amount of tension on the cable. Thereafter, any slack in the cable is automatically retracted by an AC motor. The patent does not teach or suggest any type of a protective enclosure over the reel portion of the device. In addition, the patent does not teach or suggest any interlocks or disconnects which would allow the device rewind cycle to be interrupted in an emergency situation.

The prior art devices fail to teach or suggest the use of an enclosure with safety interlocks that prevent the motor from being engaged when a cover is in an open position. The devices are further deficient in teaching a safety hose guide assembly that is capable of disengagement in the event that the path of the device is inadvertently blocked. The prior art devices are still yet deficient in teaching an enclosure with safety interlocks that prevent or stop operation of the motorized reel when the device has been overturned.

SUMMARY OF THE INVENTION

The instant invention relates to a safety enclosure for use with an associated powered flexible elongate member rewinding reel. The enclosure has left and right side wall panels, front and rear wall panels extending between the left and right wall panels, a cover, and at least one safety interlock. The enclosure is configured for receiving a motorized rotatable reel for storing a length of flexible elongate member within the enclosure. The rotatable reel includes a hub and a pair of flanges at opposing ends of the hub, and is configured for storage, motorized take-up, and pay-out of the flexible elongate member. The safety interlock(s) are incorporated into the enclosure and prevent motorized operation of the reel when the enclosure is opened or tipped over.

The cover pivots about a pair of hinges that mount the cover to the enclosure for movement between a closed position and an open position. In a preferred embodiment each hinge includes a pocket formed in a respective side wall panel and a pin associated and cooperative with each pocket. The cover can be formed having a depending lip, and the pins can extend from the lip. Preferably, the pins are formed as cylindrical elements extending from the lip, axially aligned to one another to facilitate rotational movement.

When the cover is rotated into the open position and the interior of the enclosure is accessible, a safety interlock switch assembly prevents motorized operation of the reel. When the cover is rotated into the closed position, the cover cooperates with the safety interlock switch to allow motorized operation of the reel and the interior of the enclosure is covered.

To facilitate take-up and pay-out of the flexible elongate member with the cover closed, the front wall panel includes a cut-out portion extending downward from the top edge thereof adjacent to the junction with the cover. In this arrangement, when the cover is closed, the cut-out accommodates traversing a portion of the flexible elongate member therethrough.

In one embodiment a reciprocating level-wind assembly is linked to the hose reel. When the hose reel is rotated, the reciprocating level-wind will move back and forth across the reel to uniformly and smoothly wrap the flexible elongate member on the motorized reel to provide a compact storage configuration. The reciprocating level-wind is constructed and arranged to be released from its double-helix lead-screw in the event that its path becomes blocked, such as by debris or when a hand or arm is mistakenly placed in the opening during operation. Alternatively, the level-wind may be manually disengaged to facilitate easy pay-out of the flexible elongate member and can thereafter be repositioned before being manually re-engaged to the double-helix lead-screw.

Therefore, it is an objective of the present invention to provide a motorized reel safety enclosure wherein the motorized portion of the device is prevented from operation when a portion of the enclosure is opened.

It is another objective of the present invention to provide a motorized reel safety enclosure wherein the motorized portion of the device is prevented from operation when the enclosure has been inadvertently overturned or tilted beyond a predetermined range.

It is a further objective of the present invention to provide a motorized reel safety enclosure that includes safety interlocks to prevent motorized operation when the enclosure is opened.

It is still a further objective of the present invention to provide a motorized reel safety enclosure that includes a manually disengageable and manually engageable level-wind mechanism.

Yet another objective of the present invention is to provide a motorized reel safety enclosure that includes a level-wind assembly that automatically disengages in the event that its path becomes blocked.

Still yet another objective of the present invention is to provide a motorized reel safety enclosure that is aesthetically appealing to consumers.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
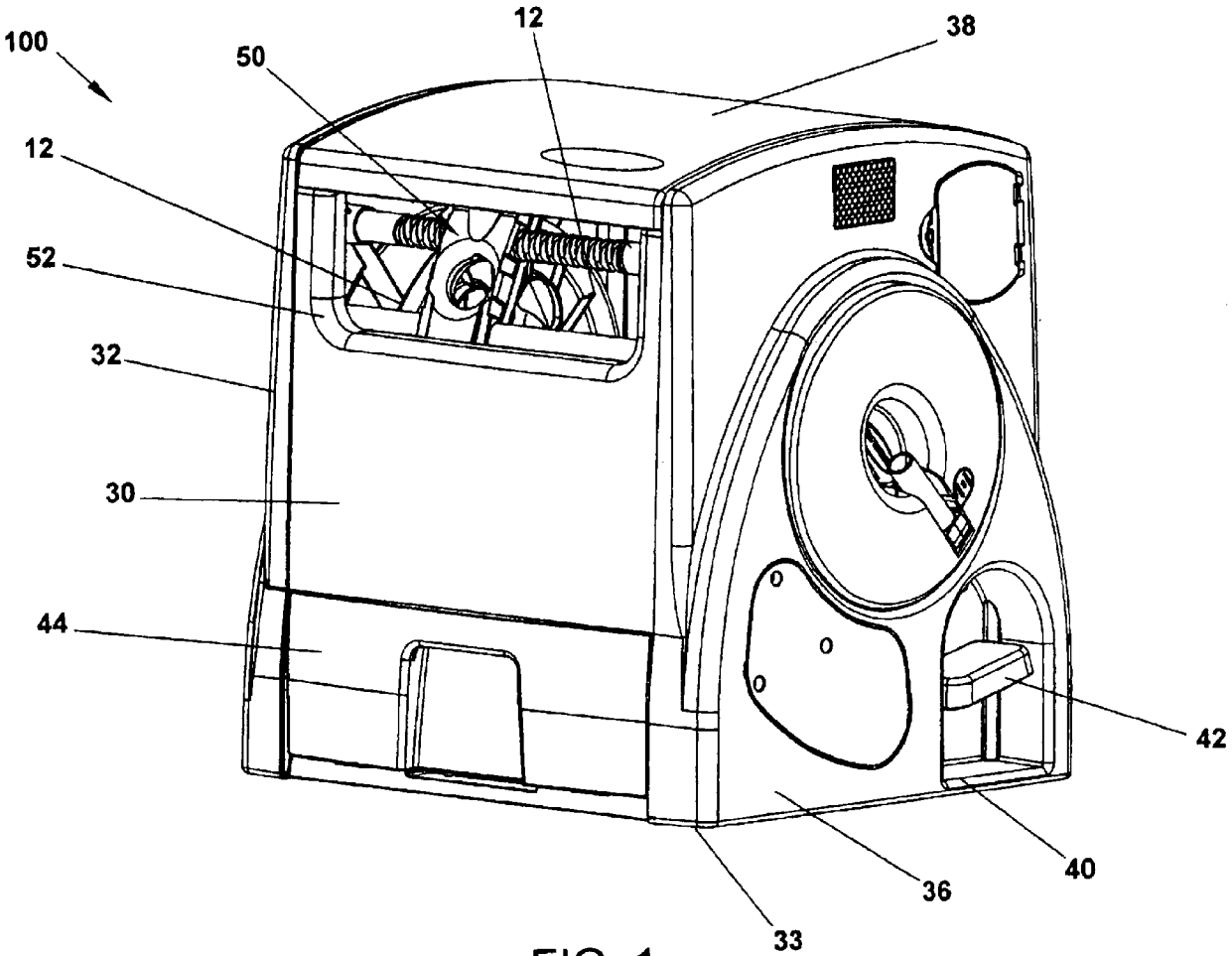
FIG. 1 is a perspective view of the safety enclosure for a powered reel device of the instant invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Referring now to FIG. 1, generally, there is shown a safety enclosure 100 in accordance with the principles of the present invention. The safety enclosure 100 is generally constructed and arranged to enclose a motor driven reel or spool 12 onto which a flexible elongate member is mechanically wound or taken up, and from which the flexible elongate member is fed out or paid out.

The enclosure 100 includes front wall panel 30 and rear wall panel 34, left side wall panel 32, right side wall panel 36, and a pivoting top or cover 38. Optionally, the enclosure 100 can include a bottom panel (not shown) for substantially fully enclosing and preventing unwanted access to the powered reel 12 during operation. The optional bottom panel is preferably constructed as a reversible member with a enhanced friction engaging first surface and a relatively smooth second surface. In this manner the bottom panel could be inserted to prevent the apparatus from skidding on hard surfaces where staking is not practical. In addition, the bottom surfaces of the left side wall panel 32 and right side wall panel 36 may be constructed with optional rubber pads 33 to further engage hard surfaces. As will be apparent from the drawings, the front, rear and side panels 30–36, and the cover 38 enclose the reel 12 such that the motorized reel is substantially not accessible from outside of the enclosure 14 when the cover 38 is closed. Those skilled in the art will recognize that this arrangement covers pinch points associated with the motorized reel and the drive train required to motorize the reel.

In a typical arrangement, the reel 12 is supported by and rotatably mounted within the enclosure 100. The reel 12 generally includes a central hub and a pair of radially extending flanges that are configured to accommodate a length of the flexible elongate member wrapped around the hub between the flanges. To prevent torquing and/or twisting of internal components, the left side panel 32 is constructed and arranged for a sliding seal arrangement 20 (FIG. 4) mounted to the enclosure 100 at about the axis of rotation of the reel 12. Those skilled in the art will recognize that this arrangement permits the flexible elongate member to remain in fluid communication with a fluid supply while the motorized reel is rotated to rewind the flexible elongate member.

In a first embodiment, the front panel 30 of enclosure 100 includes a cut-out portion 52 extending downwardly from the top lip thereof. The cut-out portion 52 can be elongated and is suitably sized to accommodate a flexible elongate member so that the flexible elongate member can be paid-out from or taken-up onto the spool 12 without lifting the cover 38. That is, the flexible elongate member can freely move through the cut-out opening 52 without opening the cover 38.

In a most preferred embodiment, the front panel 30 of enclosure 100 includes an elongated cut-out portion 52 extending downwardly from a top lip thereof. The cut-out portion 52 is sized to accommodate a reciprocating level-wind assembly 50 so that the flexible elongate member can be uniformly and smoothly wrapped on the reel 12 to provide a compact storage configuration or easily paid-out from the spool 12 without lifting the cover 38.

Figure 3:
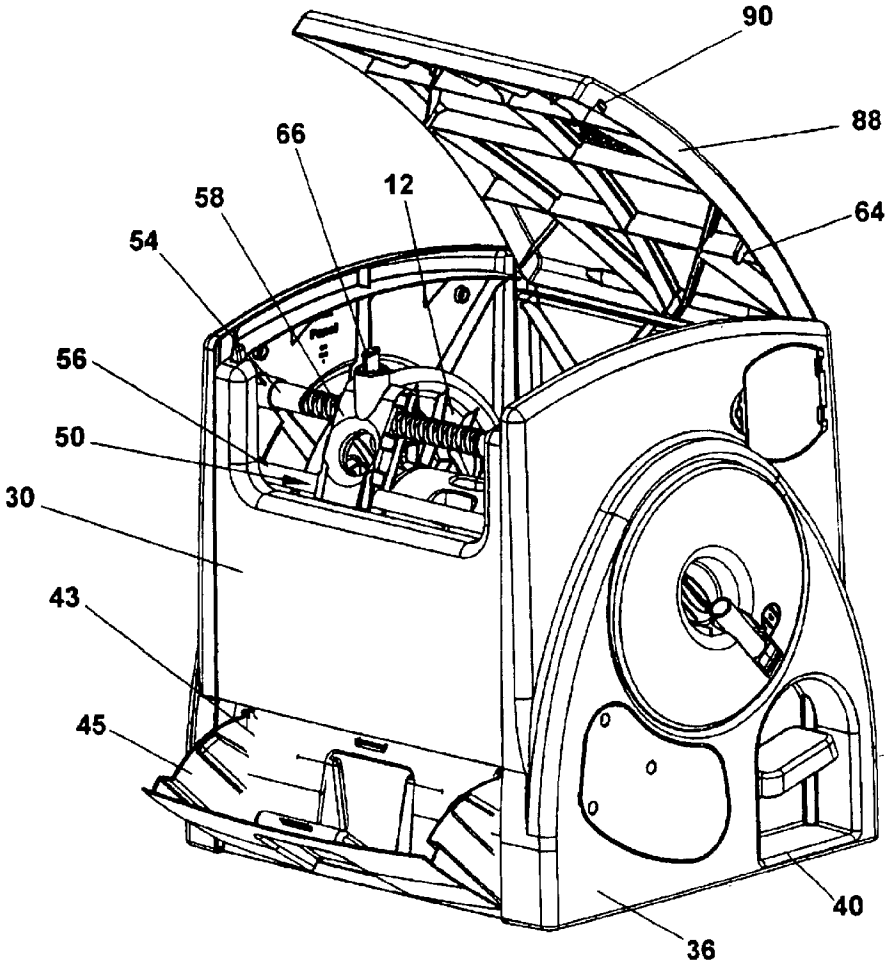
FIG. 3 is a perspective view illustrating the safety enclosure for a powered reel device with the cover in an open position.

The enclosure 100 may also include a drawer 44 extending between the right and left side panels 36, 32, parallel to the front panel 30. The drawer 44 is illustrated as opening in a pivotal fashion but may also be configured to slide open for accommodating storage of hose attachments and the like. The drawer 44 (FIG. 3) is constructed having sides 45 and a rear wall 43 to prevent an operator from inadvertently reaching into the enclosure during operation of the reel 12.

The enclosure 100 may include a foot pedal housing 40 extending inwardly into the right side panel 36 for housing a foot pedal 42. The foot pedal 42 may be utilized for operation of the motorized reel 12. The foot pedal housing 40 is used to protect the foot pedal from inadvertent operation. The foot pedal housing 40 can be provided in a variety of configurations suitable for protecting the pedal 42 from inadvertent operation, such configurations will be recognized by those skilled in the art. Alternatively, those skilled in the art will recognize the enclosure may include buttons or switches mounted to the enclosure and positioned to prevent inadvertent access to the motorized reel or its associated drive train during operation, e.g. palm buttons and the like. Because the enclosure prevents operation when a cover is opened, remote transmitters and receivers well known in the art may also be used to cause motorized operation of the reel.

Figure 2:
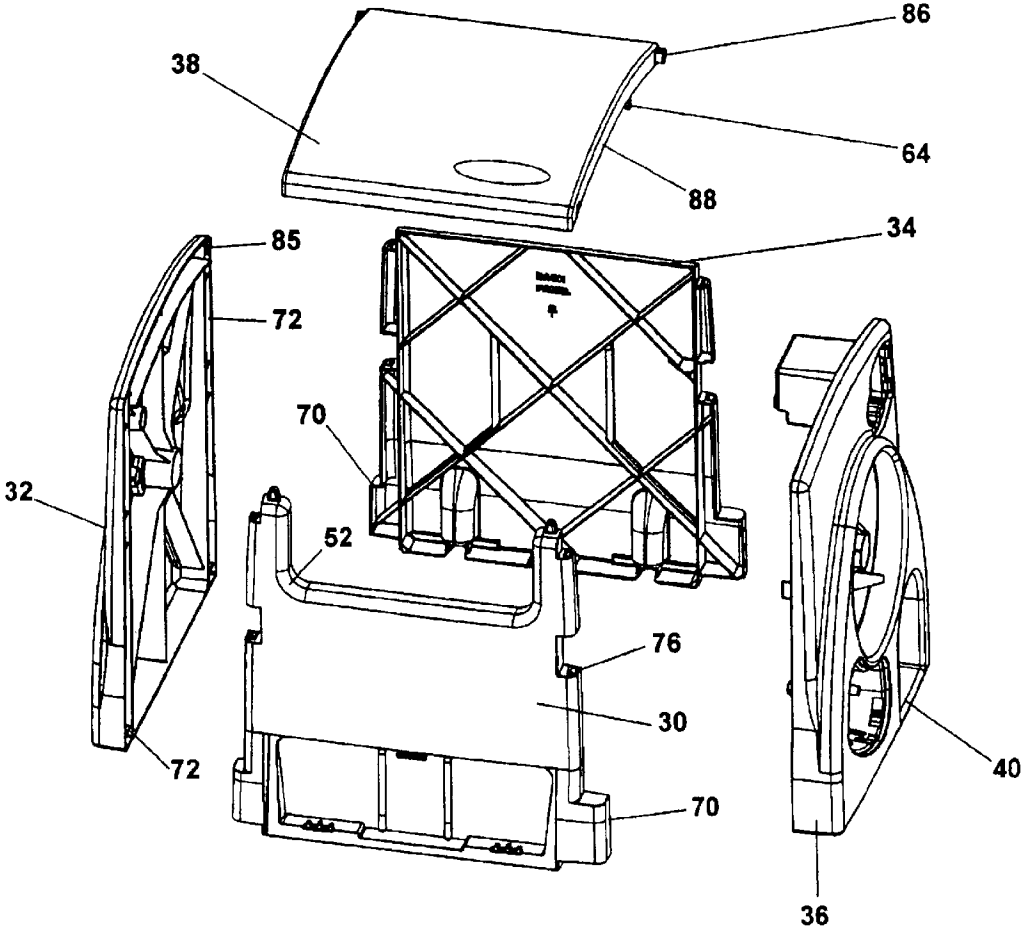
FIG. 2 is an exploded perspective view of the safety enclosure for a powered reel device.

Referring to FIG. 2, an exploded view of the enclosure is shown. The panels 30–38 are preferably molded components formed from high strength polymeric (plastic) material, such as polystyrene and the like. The panels 30–38 are most preferably configured such that the front and rear panels 30, 34 have contoured projecting posts 70 that insert into recesses or sockets 72 that extend vertically along each side of the side wall panels 32, 36. The contoured posts 70 include ramped surfaces or snap-type elements 76 that engage openings (not shown) to lock the panels to one another. Advantageously, this configuration permits ready assembly of the enclosure 100 with a minimum number of tools, and involves a minimum number of parts. Alternatively, the enclosure panels could be constructed and arranged to be secured together with other suitable means of fastening well known in the art, e.g. screws, bolts, adhesive and the like.

Figure 5:
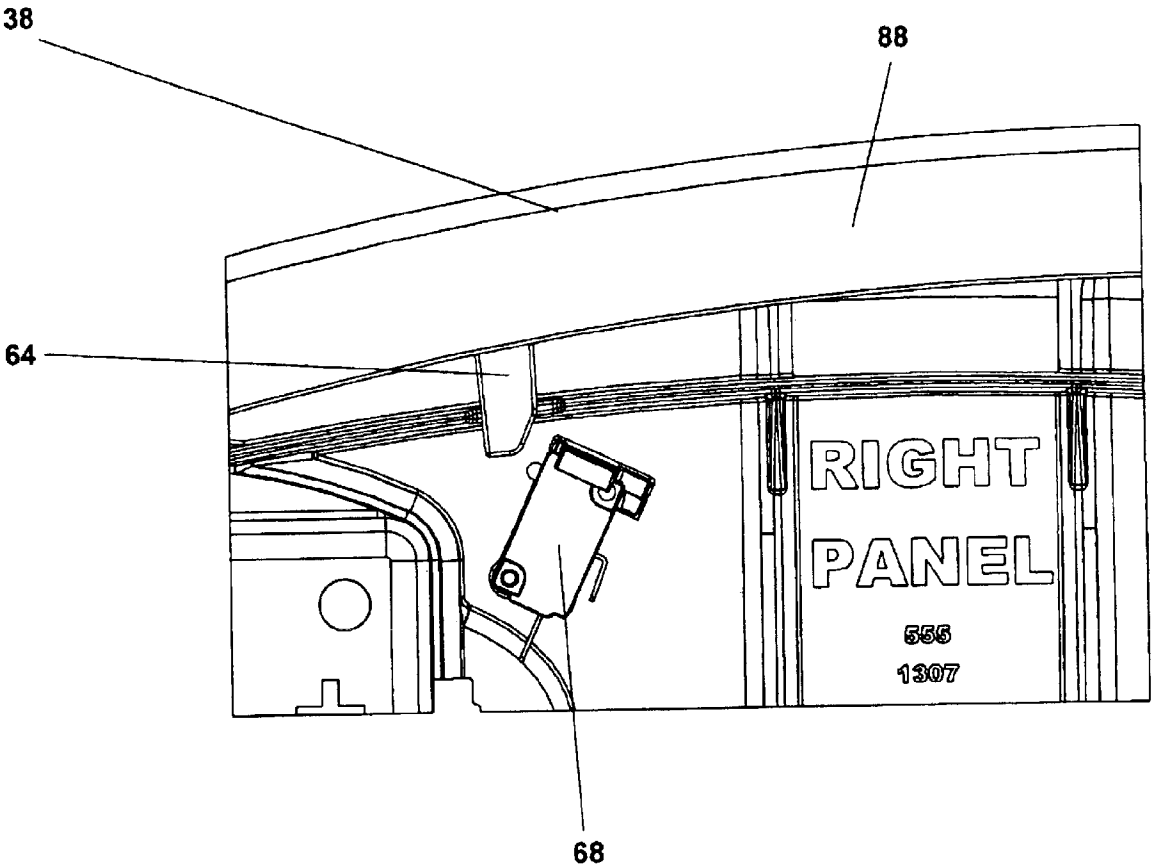
FIG. 5 is a partial section view with a portion thereof being broken away, illustrating the top cover cooperating with a safety interlock switch means.
Figures 6, 6A:
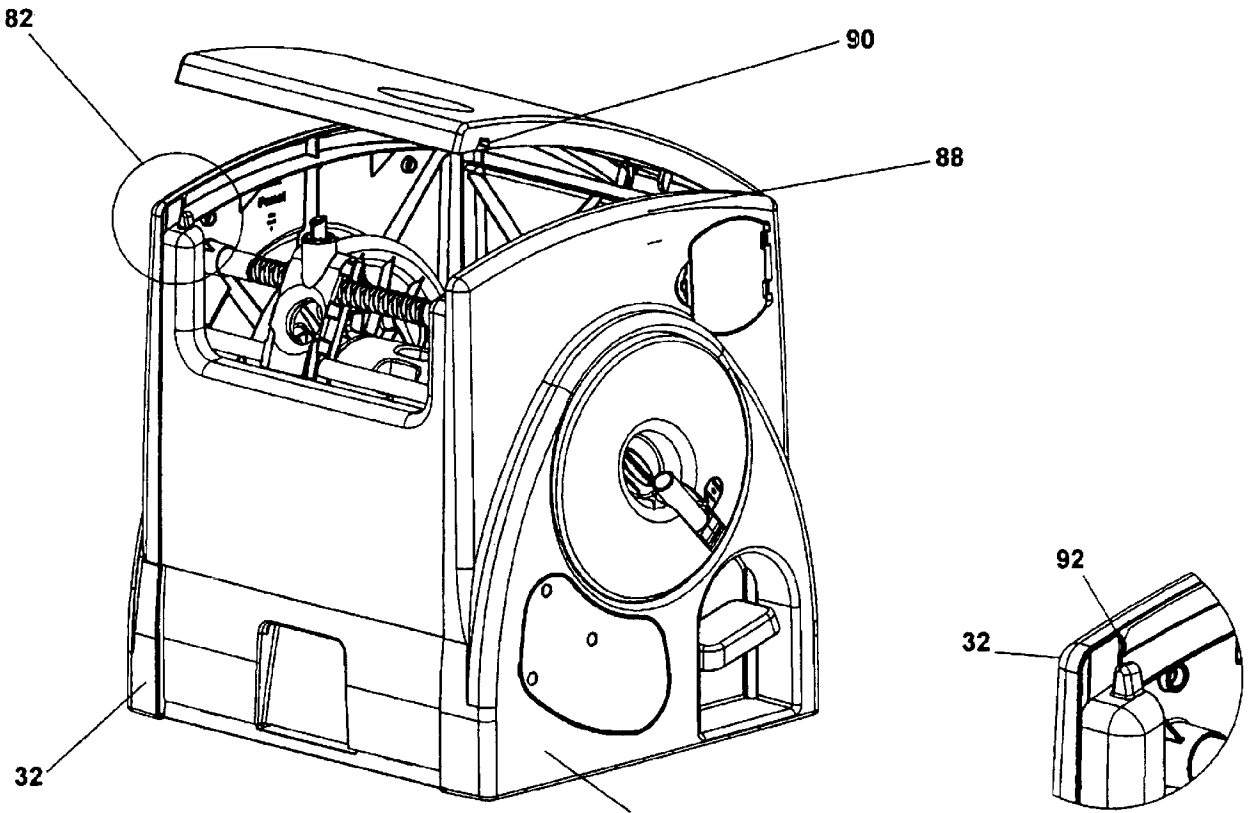
FIG. 6 is a perspective view having the reel and the level-wind omitted for clarity, illustrating the cover latch arrangement
FIG. 6A is a partial section view, illustrating the cover latch arrangement.

The cover or top panel 38 is fitted to the panels 30–36 using a hinge arrangement indicated generally at 80 (FIG. 4) and latch arrangement generally at 82, best seen in FIGS. 6 and 6A. The hinge arrangement 80 permits pivoting or rotating the cover 38 between the closed position shown in FIG. 1 and the open position shown in FIGS. 3 and 4. The cover 38 is configured so that when opened and maintained in the open position use of the motorized reel is locked out via the lockout means (FIGS. 4 and 5).

Figure 4:
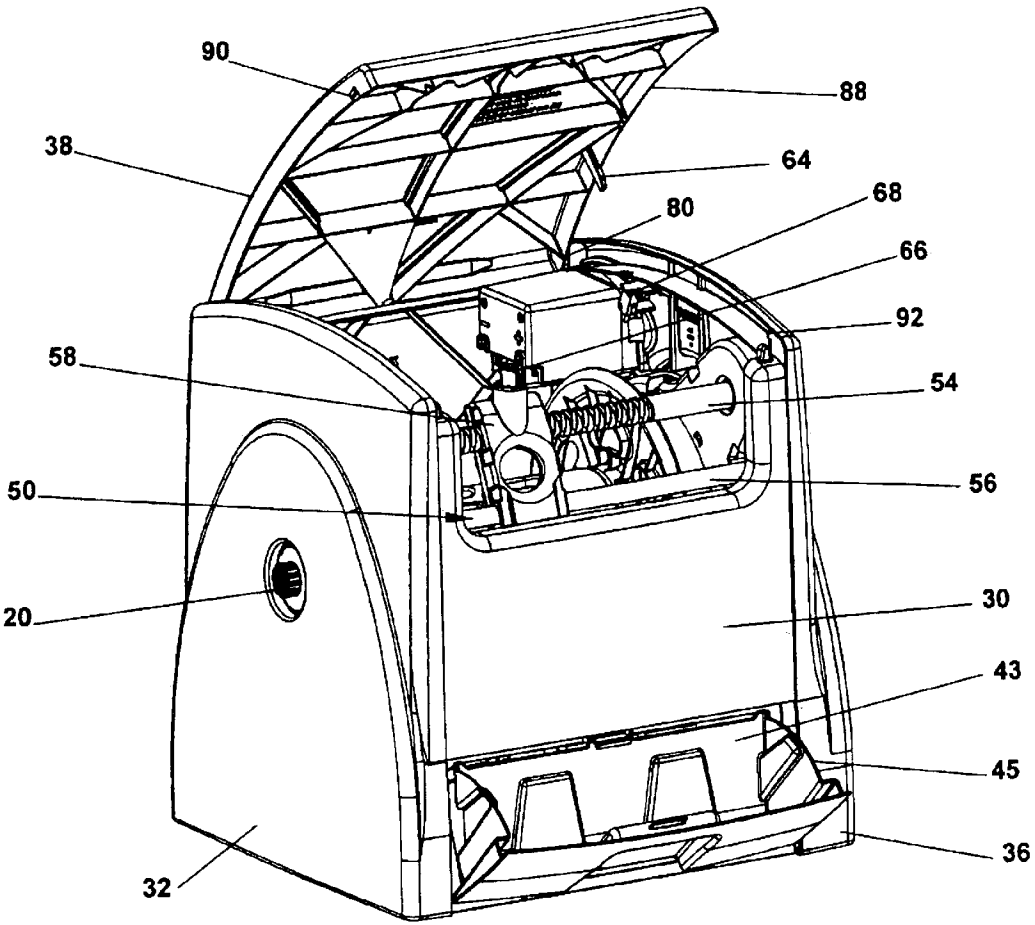
FIG. 4 is a perspective view illustrating the safety enclosure for a powered reel device with the cover in an open position.

The preferred hinge arrangement 80 includes a pocket 85 (FIG. 2) formed in each of the side panels 32, 36 at about the upper rear corners as indicated at (FIG. 4). A pair of outwardly extending pivot pins 86 (FIG. 2), extend from each side of the rear corners of the cover 38. In a present embodiment, the cover 38 has a depending lip 88, from which the pivot pins 86 extend. Each of the pivot pins 86 is configured to engage a respective pocket. The pins 86 are configured to cooperate with their respective pocket to permit pivoting or rotating the cover 38.

Now referring to FIGS. 4 and 5, the motorized hose rewinding apparatus 100 is illustrated with the cover 38 and drawer 44, in their respective open positions. Incorporated into the enclosure cover 38 is at least one lockout means that prevents the motorized reel from operating when the cover 38 is in the open position. The lockout means is illustrated as, but not limited to, an engagement pin 64 cooperating with a normally open micro-switch 68 (FIG. 4). Other devices well known in the art suitable for sensing an open cover panel and locking out electrical devices may be substituted for the pin and switch assembly illustrated herein. Such devices may include but should not be limited to micro-switches, proximity switches, mercury switches, mechanical switches, optical switches and the like.

Also visible is the reciprocating level-wind assembly 50. The reciprocating level-wind assembly contains a double helix lead-screw 54, guide rod 56, and carriage 58. The reciprocating level-wind assembly 50 is linked via a gear train (not shown) to the reel 12 so that when the hose reel 12 is rotated, the double helix lead-screw 54 rotates at a desired ratio with respect to the reel 12. The lead-screw is journaled for rotation between side members 32 and 36 and is substantially parallel to the central hub portion of reel 12. The lead-screw 54 engages the carriage 58 via follower 66, allowing the carriage 58 to move back and forth across the lead-screw 54 and the guide rod 56 when engaged during motorized operation. The follower 66 can be manually disengaged from the lead-screw 54 to permit easy pay-out of the flexible elongate member or repositioning of the carriage 58. Operation of the level-wind assembly 50 permits the flexible elongate member to be uniformly and smoothly wrapped on the reel 12 to provide a compact storage configuration. The follower 66 may also include a disengagement feature that permits the carriage 58 to release from the lead-screw 54 in the event that the carriage 58 is obstructed during motorized rewinding of the flexible elongate member.

The enclosure 100 may also be constructed and arranged with an anti-tipping means (not shown) to prevent operation of the powered reel when the enclosure has been overturned or tipped beyond a predetermined limit. In a preferred embodiment the anti-tipping means utilizes at least one mercury switch secured within the enclosure. However, other devices well known in the art suitable for sensing a tipped or overturned enclosure and locking out electrical devices may be substituted for the mercury switch of the preferred embodiment. Such devices may include but should not be limited to micro-switches, proximity switches, mechanical switches, optical switches and the like.

As illustrated in FIGS. 6 and 6A, the releasable latch arrangement 82 is engagingly oriented when the cover 38 is in the closed position. The latch arrangement releasably secures the cover to the side, front, and rear panels to help prevent children from opening the enclosure. The releasable latching means is illustrated by, but should not be limited to, a catch and detent arrangement. Other latching devices well known in the art, capable of releaseably holding the cover of the enclosure in a closed position, may be utilized. In the closed position, the catches 90 extending from the depending cover lip 88 are engaged with the respective side panels 32 and 36. To open the cover 38, it is necessary to pivot the cover 38 upward which releaseably urges the catches upward past the detents 92.

Figure 7:
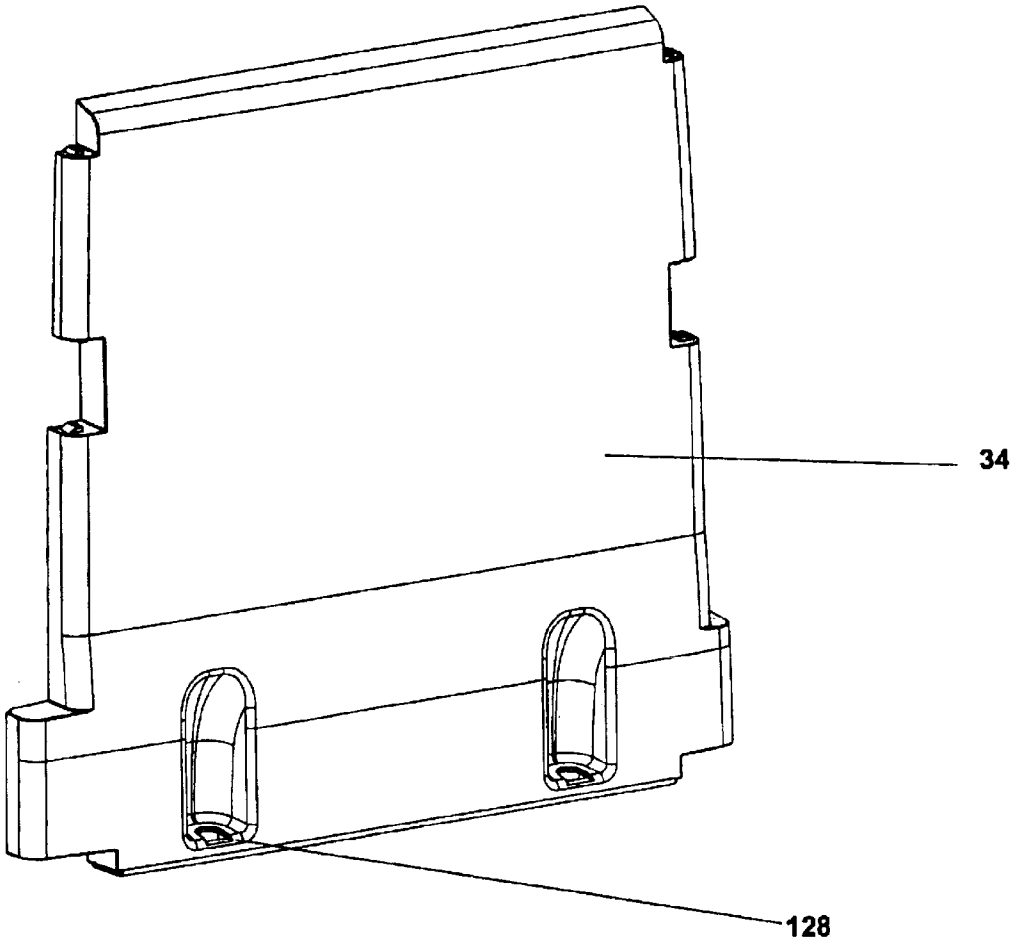
FIG. 7 is a partial rear view illustrating the recessed anchoring apertures.

Referring to FIG. 7, the lower portion of rear panel 34 of enclosure 100 is shown. The rear panel contains at least one and preferably two recessed anchoring apertures 128. The recessed apertures allow the enclosure to be securely attached to a desired surface with an attachment means such as lag bolts, spikes or metal stakes, to prevent unwanted movement overturning or tipping of the apparatus during motorized rewinding or pay-out of flexible elongate member. It should be appreciated that recessing the anchoring apertures 128 increases safety by eliminating objects extending outwardly from the enclosure.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A safety enclosure for a powered reel apparatus for use with an associated elongated flexible member comprising:

a reel having a hub defining an axis of rotation and a pair of flanges at opposing ends of said hub and perpendicular to said axis of rotation;

an enclosure having left and right side wall panels, front and rear wall panels extending between said left and right side wall panels, and a cover panel, said enclosure being constructed and arranged to receive said reel, said reel being rotatably mounted within said enclosure;

at least one electric motor constructed and arranged to cooperate with said reel to provide selective power assisted rotational movement of said reel in relation to said enclosure;

a control assembly constructed and arranged to electrically connect and disconnect said at least one electric motor to and from an electrical power source, wherein operation of said control assembly in a first mode connects said electrical power source to said electric motor to cause rotation of said reel in relation to said enclosure for powered take-up or pay out of said flexible elongate member, wherein operation of said control assembly in a second mode disconnects said electrical power source from said at least one electric motor;

at least one safety interlock means constructed and arranged to cooperate with said control assembly and said enclosure to prevent electrical connection between said electrical power source and said at least one electric motor when at least one of said enclosure panels are in an open position, thereby preventing power assisted operation of said reel.

2. The safety enclosure in accordance with claim 1 wherein, said at least one safety interlock means includes at least one switch means for monitoring said enclosure panels and disconnecting said electrical power source from said at least one electric motor when at least one of said enclosure panels are in an open position.

3. The safety enclosure in accordance with claim 2 wherein, said switch means includes at least one electrical switch, wherein said at least one electrical switch is constructed and arranged to prevent operation of said at least one electric motor when at least one of said enclosure panels are in an open position.

4. The safety enclosure in accordance with claim 3 wherein, said switch means includes at least one mechanically actuated electrical switch, wherein said at least one mechanically actuated electrical switch is constructed and arranged to prevent operation of said at least one electric motor when at least one of said enclosure panels are in an open position.

5. The safety enclosure in accordance with claim 3 wherein, said switch means includes at least one mercury switch, wherein said at least one mercury switch is constructed and arranged to prevent operation of said at least one electric motor when at least one of said enclosure panels are in an open position.

6. The safety enclosure in accordance with claim 3 wherein, said switch means includes at least one proximity switch, wherein said at least one proximity switch is constructed and arranged to prevent operation of said at least one electric motor when at least one of said enclosure panels are in an open position.

7. The safety enclosure in accordance with claim 3 wherein, said switch means includes at least one optical switch, wherein said at least one optical switch is constructed and arranged to prevent operation of said at least one electric motor when at least one of said enclosure panels are in an open position.

8. The safety enclosure in accordance with claim 1 wherein, wherein said enclosure cover includes a pair of hinges for mounting said cover to said enclosure for pivotal movement between a closed position and an open position, wherein said closed position permits powered operation of said reel, wherein said open position locks out powered operation of said reel.

9. The safety enclosure in accordance with claim 8, wherein each said hinge includes a pocket formed in a respective side wall panel and a pin associated and cooperative with each said pocket, each said pocket configured to permit rotational movement of said pins for upward rotational movement of said cover.

10. The safety enclosure in accordance with claim 9, wherein said cover includes a depending lip and wherein said pins are formed as cylindrical elements extending from said depending lip, axially aligned with one another.

11. The safety enclosure in accordance with claim 1, wherein said cover includes a releasable latch means for releasably holding said cover in a closed position.

12. The safety enclosure in accordance with claim 11, wherein said releasable latch means includes at least one catch, said at least one catch extending outwardly from said depending lip and cooperating with at least one detent, said at least one detent constructed and arranged to cooperate with said catch and incorporated into said side panels;

wherein said cover is opened by lifting the front portion of said cover upwardly, urging said catches past said detents.

13. The safety enclosure in accordance with claim 1, wherein said control assembly includes at least one foot operated switch, wherein at least one of said side wall panels include a foot pedal housing extending inwardly into said side wall panel for housing said foot operated switch, wherein selective operation of said foot operated switch electrically connects said at least one electric motor to said electrical power source for powered take-up of said flexible elongate member, wherein said foot pedal housing is constructed and arranged to protect said foot operated switch from inadvertent operation.

14. The safety enclosure in accordance with claim 1, wherein said enclosure includes an opening therein configured for take-up and pay-out of said flexible elongate member when said cover is in the closed position.

15. The safety enclosure in accordance with claim 1, wherein said front wall panel includes a cut-out portion at about a top edge thereof adjacent a junction with said cover when said cover is in the closed position, said cut-out configured for traversing a portion of said flexible hose therethrough to take-up and pay-out said hose with said cover in the closed position.

16. The safety enclosure in accordance with claim 1, wherein said left and right side panels each include elongated sockets formed therein, said sockets extending along the front and back edges thereof and integral with said panels, wherein said front and rear panels include elongated contoured posts extending outwardly from ends thereof and integral therewith, the posts being adapted to insert into the sockets for securing to the left and right panels.

17. The safety enclosure in accordance with claim 1, wherein said left and right side panels each include at least one rubber pad fixedly secured to a bottom surface of each of said left and right side wall panels for engaging a surface to resist skidding of said safety enclosure device during operation.

18. The safety enclosure in accordance with claim 1, wherein said front panel of said enclosure includes an elongated cut-out portion at about a bottom edge thereof extending upwardly, said cut-out configured for accommodating a drawer, said drawer configured to open in a pivotal fashion.

19. The safety enclosure in accordance with claim 18, wherein said drawer is constructed and arranged to include sides and a rear wall to prevent inadvertent reaching into said enclosure during operation of said reel.

20. The safety enclosure in accordance with claim 1, wherein said rear wall panel further includes at least one recessed anchoring aperture, said at least one recessed anchoring aperture configured and arranged to anchor said enclosure to a surface or a suitable structure, whereby unwanted movement of said enclosure is prevented.

21. The safety enclosure in accordance with claim 20, wherein said rear wall panel contains two said recessed anchoring apertures.

22. The safety enclosure in accordance with claim 1, wherein said hose winding apparatus further includes a level-wind comprising:

a double helix lead screw, said double helix lead screw substantially parallel to and spaced apart from said reel axis of rotation and suitably supported and journaled in said left and said right side wall panels;

a guide rod substantially parallel to said reel axis of rotation, suitably supported by said left and said right side wall panels;

a carriage, said carriage constructed and arranged to cooperate with said double helix lead screw and said guide rod; and a hose guide gear-train, said gear train constructed and arranged to transfer rotary motion from said reel to said double helix lead-screw;

wherein said carriage reciprocates back and forth across said lead screw and said guide rod when said reel is rotated to uniformly and smoothly wrap said flexible elongate member on said reel for a compact storage configuration.

23. The safety enclosure in accordance with claim 22, wherein said carriage includes a follower assembly, said follower assembly constructed and arranged to cooperatively engage said lead-screw.

24. The safety enclosure in accordance with claim 23, wherein said follower assembly is manually disengageable from said lead-screw and manually re-engageable to said lead-screw, wherein said flexible elongate member can be manually pulled from said reel without reciprocation of said level-wind and said level-wind is repositionable and re-engageable to said lead-screw.

* * * * *